US007475557B2

(12) United States Patent
Yoshioka et al.

(10) Patent No.: US 7,475,557 B2
(45) Date of Patent: Jan. 13, 2009

(54) REFRIGERATOR

(75) Inventors: Takahiro Yoshioka, Osaka (JP); Minoru Temmyo, Osaka (JP); Hidetake Hayashi, Osaka (JP)

(73) Assignees: Kabushiki Kaisha Toshiba, Tokyo (JP); Toshiba Consumer Marketing Corporation, Tokyo (JP); Toshiba Ha Products Co., Ltd., Ibaraki-shi (JP)

( * ) Notice: Subject to any disclaimer, the term of this patent is extended or adjusted under 35 U.S.C. 154(b) by 512 days.

(21) Appl. No.: 10/547,393

(22) PCT Filed: Nov. 17, 2004

(86) PCT No.: PCT/JP2004/017084

§ 371 (c)(1),
(2), (4) Date: Aug. 31, 2005

(87) PCT Pub. No.: WO2005/061976

PCT Pub. Date: Jul. 7, 2005

(65) Prior Publication Data

US 2006/0179858 A1 Aug. 17, 2006

(30) Foreign Application Priority Data

Dec. 22, 2003 (JP) ..... 2003-425918

(51) Int. Cl.
*F25B 7/00* (2006.01)
*F25B 5/00* (2006.01)
*F25B 41/00* (2006.01)

(52) U.S. Cl. ..... 62/175; 62/200; 62/510; 62/513

(58) Field of Classification Search ..... 62/175, 62/199, 200, 504, 510, 513, 525
See application file for complete search history.

(56) References Cited

U.S. PATENT DOCUMENTS

| | | | | |
|---|---|---|---|---|
| 6,058,723 | A * | 5/2000 | Kusunoki et al. | 62/156 |
| 6,460,357 | B1 * | 10/2002 | Doi et al. | 62/199 |
| 2007/0144190 | A1 * | 6/2007 | Temmyo et al. | 62/180 |

FOREIGN PATENT DOCUMENTS

| | | |
|---|---|---|
| CN | 1129759 C | 12/2003 |
| JP | 5-196336 | 8/1993 |
| JP | 2000-146411 | 5/2000 |
| JP | 2000-230766 | 8/2000 |
| JP | 2002-107027 | 4/2002 |

* cited by examiner

*Primary Examiner*—Marc E Norman
(74) *Attorney, Agent, or Firm*—Oblon, Spivak, McClelland, Maier & Neustadt, P.C.

(57) ABSTRACT

The invention provides a refrigerator having a two-stage compression compressor capable of performing efficient cooling of a both a refrigerator compartment and a freezer compartment. A high-pressure delivery outlet of a two-stage compression compressor 12 is connected to a condenser 14, the condenser 14 is connected to a three-way valve 15, a first outlet of the three-way valve 15 is connected via an R capillary tube 16 and an R evaporator 18 to an intermediate-pressure intake of the two-stage compression compressor 12, is connected and via an F capillary tube 24 to an F evaporator 26, the F evaporator is connected to a low-pressure intake of the two-stage compression compressor 12 via a low-pressure suction pipe 28, the three-way valve 15 can switch between a simultaneous cooling mode and a freezer mode, and when in the simultaneous cooling mode the interior temperature of the refrigerator compartment 2 falls to a predetermined temperature it switches to the freezer mode.

2 Claims, 4 Drawing Sheets

REFRIGERATOR

TECHNICAL FIELD

This invention relates to a refrigerator having a two-stage compression compressor.

BACKGROUND ART

In related art, as refrigerators having a refrigerating cycle in which a two-stage compression compressor is used to feed coolant to two evaporators, refrigerators of the following kind have been proposed.

That is, refrigerators have been proposed (see for example Patent Document 1) wherein an opening/closing valve is disposed at the outlet of a condenser and by this opening/closing valve being switched either a simultaneous cooling mode, in which coolant is passed through a refrigerator evaporator (hereinafter called the R evaporator) and a freezer evaporator (hereinafter called the F evaporator) in turn to cool the R evaporator and the F evaporator simultaneously, is effected, or a freezer mode, in which coolant is passed from the opening/closing valve via a bypass pipe into the freezer evaporator (hereinafter, the F evaporator) only, is effected.

Patent Document 1: JP-A-2002-31459

DISCLOSURE OF THE INVENTION

Problems that the Invention is to Solve

In a refrigerator of the kind described above, in the simultaneous cooling mode, in which a refrigerator compartment and a freezer compartment are cooled simultaneously, there is the problem that the evaporator temperature of the R evaporator and the evaporator temperature of the F evaporator become the same, and it is not possible to increase the efficiency of the refrigerating cycle.

And, because the absolute value of the evaporator temperature of the R evaporator is low, there is the problem that the relative humidity inside the refrigerator compartment is low.

Also, as a result of switching of the opening/closing valve being carried out on the basis of when it is necessary for cooling of the respective rooms of the refrigerator compartment and the freezer compartment, there is the problem that loss in the opening/closing valve and temperature increase during the waiting time on one side during alternating cooling appear, fine temperature setting is not possible, and it is not possible to obtain further temperature constancy of the rooms.

Accordingly, in view of these problems, the present invention provides a refrigerator having a two-stage compression compressor with which it is possible to effect efficient cooling of both a refrigerator compartment and a freezer compartment.

Means for Solving the Problems

An invention pertaining to claim 1 is, in a refrigerator having a refrigerating cycle in which a high-pressure delivery outlet of a two-stage compression compressor is connected to a condenser, the condenser is connected to coolant flow path switching means, a first outlet of the switching means is connected via a high-pressure side capillary tube and a refrigerator compartment evaporator to an intermediate-pressure intake of the two-stage compression compressor, a second outlet of the switching means is connected via a low-pressure side capillary tube to a freezer compartment evaporator, and the freezer compartment evaporator is connected via a low-pressure suction pipe to a low-pressure intake of the two-stage compression compressor, a refrigerator characterized in that with the switching means it is possible to switch between a simultaneous cooling mode in which coolant is passed to the refrigerator compartment evaporator and the freezer compartment evaporator simultaneously and a freezer mode in which coolant is passed to the freezer compartment evaporator only, and it has control means for controlling the switching means to switch to the freezer mode when in the simultaneous cooling mode the interior temperature of the refrigerator compartment has fallen to a predetermined temperature.

An invention pertaining to claim 2 is a refrigerator according to claim 1 characterized in that the control means switches to the freezer mode after a predetermined time elapses from the start of the simultaneous cooling mode even if the interior temperature of the refrigerator compartment does not fall to the predetermined temperature.

An invention pertaining to claim 3 is a refrigerator according to claim 1 characterized in that when the interior temperature of the refrigerator compartment has risen to a defrosting end temperature the control means switches from the freezer mode to the simultaneous cooling mode.

An invention pertaining to claim 4 is a refrigerator according to claim 1 characterized in that after a predetermined time elapses from the start of the freezer mode the control means switches to the simultaneous cooling mode.

An invention pertaining to claim 5 is a refrigerator according to claim 1 characterized in that in the freezer mode the control means drives a refrigerator circulating fan provided in the vicinity of the refrigerator compartment evaporator.

Advantage of the Invention

In a refrigerator of the invention pertaining to claim 1, when the interior temperature of the refrigerator compartment falls to a predetermined temperature in the simultaneous cooling mode, in which both the freezer compartment and the refrigerator compartment are cooled, because there is no need for the temperature of the refrigerator compartment to be lowered any further, the control means performs control so as to switch to the freezer mode using the switching means. As a result, the refrigerator compartment is not cooled more than is necessary.

In a refrigerator of the invention pertaining to claim 2, even if the interior temperature of the refrigerator compartment does not fall to the predetermined temperature, after a predetermined time elapses from the start of the simultaneous cooling mode, the mode is switched to the freezer mode. By this means, it is possible to prevent the time of the simultaneous cooling mode becoming too long and the temperature of the freezer compartment rising too far.

In a refrigerator of the invention pertaining to claim 3, when in the freezer mode the interior temperature of the refrigerator compartment has risen to a defrosting end temperature, it is inferred that defrosting has finished, and to lower the temperature of the refrigerator compartment the mode is switched from the freezer mode to the simultaneous cooling mode and the refrigerator compartment is cooled.

In a refrigerator of the invention pertaining to claim 4, by the mode being switched to the simultaneous cooling mode after a predetermined time elapses from the start of the freezer mode, the temperature of the refrigerator compartment can be prevented from rising too far.

In a refrigerator of the invention pertaining to claim 5, by a refrigerator circulating fan provided in the vicinity of the refrigerator evaporator being driven in the freezer mode and moisture present on the refrigerator evaporator being blown into the refrigerator compartment, the humidity of the interior of the refrigerator compartment is increased and so-called moisturizing operation is thereby effected. And, it is also possible to effect defrosting of the refrigerator evaporator by carrying out this moisturizing operation.

BEST MODES FOR CARRYING OUT THE INVENTION

A preferred embodiment of the invention will now be described on the basis of FIG. 1 through FIG. 4.

FIG. 1 and FIG. 2 are construction views of a refrigerating cycle of a refrigerator 1 illustrating this preferred embodiment, FIG. 3 is a vertical sectional view of the refrigerator 1, and FIG. 4 is a block diagram of the refrigerator 1.

(1) Construction of the Refrigerator 1

First, the construction of the refrigerator 1 will be described, on the basis of FIG. 3.

Inside the refrigerator 1 are provided, from the top, a refrigerator compartment 2, a vegetable compartment 3, an ice-making compartment 4, and a freezer compartment 5.

A two-stage compression compressor (hereinafter simply called the compressor) 12 is mounted in a machine compartment 6 behind of the freezer compartment 5.

A freezer compartment evaporator (hereinafter called the F evaporator) 26 for cooling the ice-making compartment 4 and the freezer compartment 5 is mounted on the back wall of the ice-making compartment 4.

Also, a refrigerator compartment evaporator (hereinafter called the R evaporator) 18 for cooling the refrigerator compartment 2 and the vegetable compartment 3 is mounted on the back wall of the vegetable compartment 3.

A circulating fan (hereinafter called the F fan) 27 for circulating cold air cooled by the F evaporator 26 around the ice-making compartment 4 and the freezer compartment 5 is mounted above the F evaporator 26.

A circulating fan (hereinafter called the R fan) 19 for circulating cold air cooled by the R evaporator 18 around the refrigerator compartment 2 and the vegetable compartment 3 is mounted above the R evaporator 18.

A control part 7 consisting of a microcomputer is mounted on the back of the ceiling part of the refrigerator 1.

And, an R sensor 8 for measuring interior temperature is disposed in the refrigerator compartment 2, and an F sensor 9 for measuring interior temperature is disposed in the freezer compartment 5.

(2) Construction of the Refrigerating Cycle 10

The construction of a refrigerating cycle 10 of the refrigerator 1 will now be described on the basis of FIG. 1.

A condenser 14 is connected to a high-pressure delivery outlet of the compressor 12, and a three-way valve 15 is connected to the condenser 14. A high-pressure side capillary tube (hereinafter called the R capillary tube) 16 and the R evaporator 18 are connected in turn to a refrigerator outlet of the three-way valve 15.

The outlet side of the R evaporator 18 is connected via an intermediate-pressure suction pipe 22 to an intermediate-pressure intake of the compressor 12.

A freezer outlet of the three-way valve 15 is connected via a low-pressure side capillary tube (hereinafter called the F capillary tube) 24 to the F evaporator 26. The outlet side of the F evaporator 26 is connected via a low-pressure suction pipe 28 to a low-pressure intake of the compressor 12.

The R capillary tube 16 and the intermediate-pressure suction pipe 22 are mounted in proximity to each other so that heat exchange between them is possible. By heat being imparted to the intermediate-pressure suction pipe 22 from the R capillary tube 16 in this way, liquid coolant inside the intermediate-pressure suction pipe can be vaporized and backing of liquid into the compressor 12 can be prevented.

The F capillary tube 24 and the low-pressure suction pipe 28 are also mounted in proximity to each other so that heat exchange between them is possible. And by heat being imparted to the low-pressure suction pipe 28 from the F capillary tube 24 like this, liquid coolant can be vaporized and backing of liquid into the compressor 12 can be prevented.

(3) Electrical Construction of the Refrigerator 1

Next, the electrical construction of the refrigerator 1 will be described, on the basis of FIG. 4.

A motor of the compressor 12, the R fan 19, the F fan 27, the three-way valve 15, the R sensor 8 and the F sensor 9 are connected to the control part 7, which controls the refrigerator 1.

In accordance with a pre-stored program (a program for realizing operating states shown below), the control part 7 controls the compressor 12, the R fan 19, the F fan 27 and the three-way valve 15 on the basis of an interior temperature of the refrigerator compartment 2 detected by the R sensor 8 (hereinafter called the R temperature) and an interior temperature of the freezer compartment 5 (hereinafter called the F temperature).

(4) Operating States of the Refrigerator 1

Next, operating states of the refrigerator 1 based on by the control part 7 will be explained.

By switching the three-way valve 15, the control part 7 can effect a simultaneous cooling mode for cooling the refrigerator compartment 2 and the vegetable compartment 3 (hereinafter referred to together as the refrigerator compartment 2) and the ice-making compartment 4 and the freezer compartment 5 (hereinafter referred to together as the freezer compartment 5) and a freezer mode for cooling the freezer compartment 5 only.

(4-1) Simultaneous Cooling Mode

The simultaneous cooling mode is a mode in which by coolant being passed through the two outlets of the three-way valve 15 simultaneously, as shown in FIG. 1, the R evaporator 18 and the F evaporator 26 are cooled and the refrigerator compartment 2 and the freezer compartment 5 are cooled simultaneously. There are two flows of coolant in this simultaneous cooling mode. The first flow runs from the compressor 12 to the condenser 14, through the three-way valve 15 and through the R capillary tube 16, the R evaporator 18 and the intermediate-pressure suction pipe 22 back to the compressor 12. The second flow runs from the three-way valve 15 through the F capillary tube 24 and through the F evaporator 26 and the low-pressure suction pipe 28 back to the compressor 12. In this case, the diameter of the R capillary tube 16 is made larger than the diameter of the F capillary tube 24 so that at the two outlets of the three-way valve 15 a pressure difference and coolant flow resistances are such that coolant flows more easily into the R evaporator 18.

As the state of the coolant inside the R evaporator 18, at the inlet of the R evaporator 18 the coolant is liquid, inside the R evaporator 18 the liquid coolant evaporates, and immediately before the outlet the coolant is gaseous. As a result, there is no backing of liquid into the intermediate-pressure intake of the compressor 12 via the intermediate-pressure suction pipe 22. To make the coolant gaseous immediately before the outlet like this, the temperature at the vicinity of the inlet of the R evaporator 18 and that at the vicinity of the outlet are each detected, and the flow of coolant from the three-way valve 15 to the R evaporator 18 is regulated so that the difference between the inlet temperature and the outlet temperature is about 4° C.

(4-2) Freezer Mode

In the freezer mode, as shown in FIG. 2, the R evaporator 18 side outlet of the three-way valve 15 is closed, and coolant is allowed to flow only to the F evaporator 26 side. The flow of coolant runs via the compressor 12, the condenser 14, the three-way valve 15, the F capillary tube 24 and the F evaporator 26 and through the low-pressure suction pipe 28 back the compressor 12.

Next, the switching conditions of the two modes will be explained.

(4-3) Switching from the Simultaneous Cooling Mode to the Freezer Mode

In the simultaneous cooling mode, the refrigerator compartment 2 and the freezer compartment 5 are both cooled. And when the interior temperature of the refrigerator compartment 2 falls and the detected temperature of the R sensor 8 falls as far as a refrigeration end temperature, the control part 7 ends the simultaneous cooling mode and switches to the freezer mode.

As a result, there is no cooling of the interior of the refrigerator compartment 2 beyond that which is necessary, and the two rooms can be cooled efficiently.

However, when the interior temperature of the refrigerator compartment 2 has not fallen to the refrigeration end temperature even after a predetermined time has elapsed from the start of the simultaneous cooling mode (for example 30 minutes), the simultaneous cooling mode is ended and the freezer mode switched to, forcibly. The reason for this is that when the simultaneous cooling mode is effected for too long a time, because the cooling capacity of the freezer compartment 5 is low there is a possibility of the interior temperature of the freezer compartment 5 rising, and to prevent this the simultaneous cooling mode is not effected for longer than a predetermined time and the freezer mode is switched to forcibly.

(4-4) Switching from the Freezer Mode to the Simultaneous Cooling Mode

In the freezer mode, the refrigerator compartment 2 is not cooled and only the freezer compartment 5 is cooled. Because of this, as switching conditions for this, there are the following two conditions.

The first condition is as follows.

When a predetermined time has elapsed from the start of the freezer mode (for example 1 hour), the mode is switched from the freezer mode to the simultaneous cooling mode. As a result, the interior temperature of the refrigerator compartment 2 does not rise too much.

The second condition is as follows.

In the freezer mode, the R fan 19 mounted in the vicinity of the R evaporator 18 is driven and moisture on the R evaporator 18 is blown into the refrigerator compartment 2 to raise the humidity of its interior, whereby moisturizing operation is effected and defrosting of the R evaporator 18 is effected at the same time. Then, when the temperature detected by the R sensor 8 or the detected temperature of a sensor (not shown) for detecting the temperature of the R evaporator 18 reaches a defrosting end temperature, the mode is switched from the freezer mode to the simultaneous cooling mode.

In this second condition, because when defrosting ends the mode is switched to the simultaneous cooling mode, cooling of the refrigerator compartment 2 can be carried out without fail after the end of defrosting, and the interior temperature of the refrigerator compartment 2 does not rise too far.

(5) Effects of the Preferred Embodiment

In the case of a refrigerator 1 according to the preferred embodiment described above, because switching from the simultaneous cooling mode to the freezer mode is carried out on the basis of the interior temperature of the refrigerator compartment 2, the refrigerator compartment 2 is never cooled more than necessary. And when the simultaneous cooling mode has been effected for a predetermined time, because the mode is switched to the freezer mode forcibly, the interior temperature of the freezer compartment 5 does not rise too far.

In the case of switching from the freezer mode to the simultaneous cooling mode, because the switch is made after a predetermined time from the start of the freezer mode, the interior temperature of the refrigerator compartment 2 does not rise too far. And by the mode being switched to the simultaneous cooling mode when a defrosting end temperature of the refrigerator compartment 2 has been reached, the interior temperature of the refrigerator compartment 2 does not rise too far.

(Variation)

Whereas in the foregoing preferred embodiment defrosting was carried out by means of humidifying operation, instead of this defrosting may alternatively be carried out by means of a defrosting heater provided in the vicinity of the R evaporator 18.

The present invention is suitable for use in a household refrigerator or a commercial refrigerator.

Figure 1:
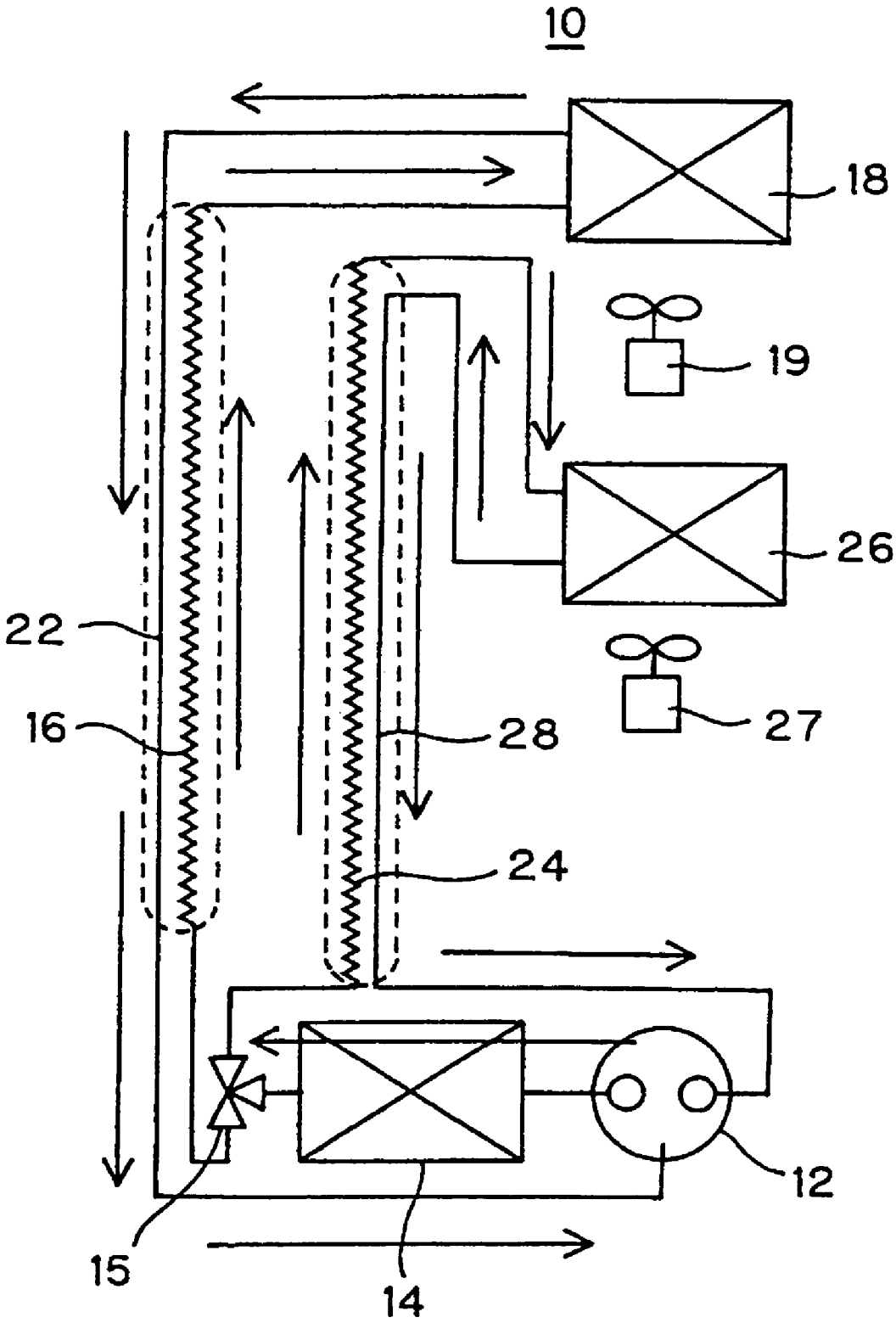
FIG. 1 is a construction view of a refrigerating cycle showing a preferred embodiment of the invention, and shows a simultaneous cooling mode.
Figure 2:
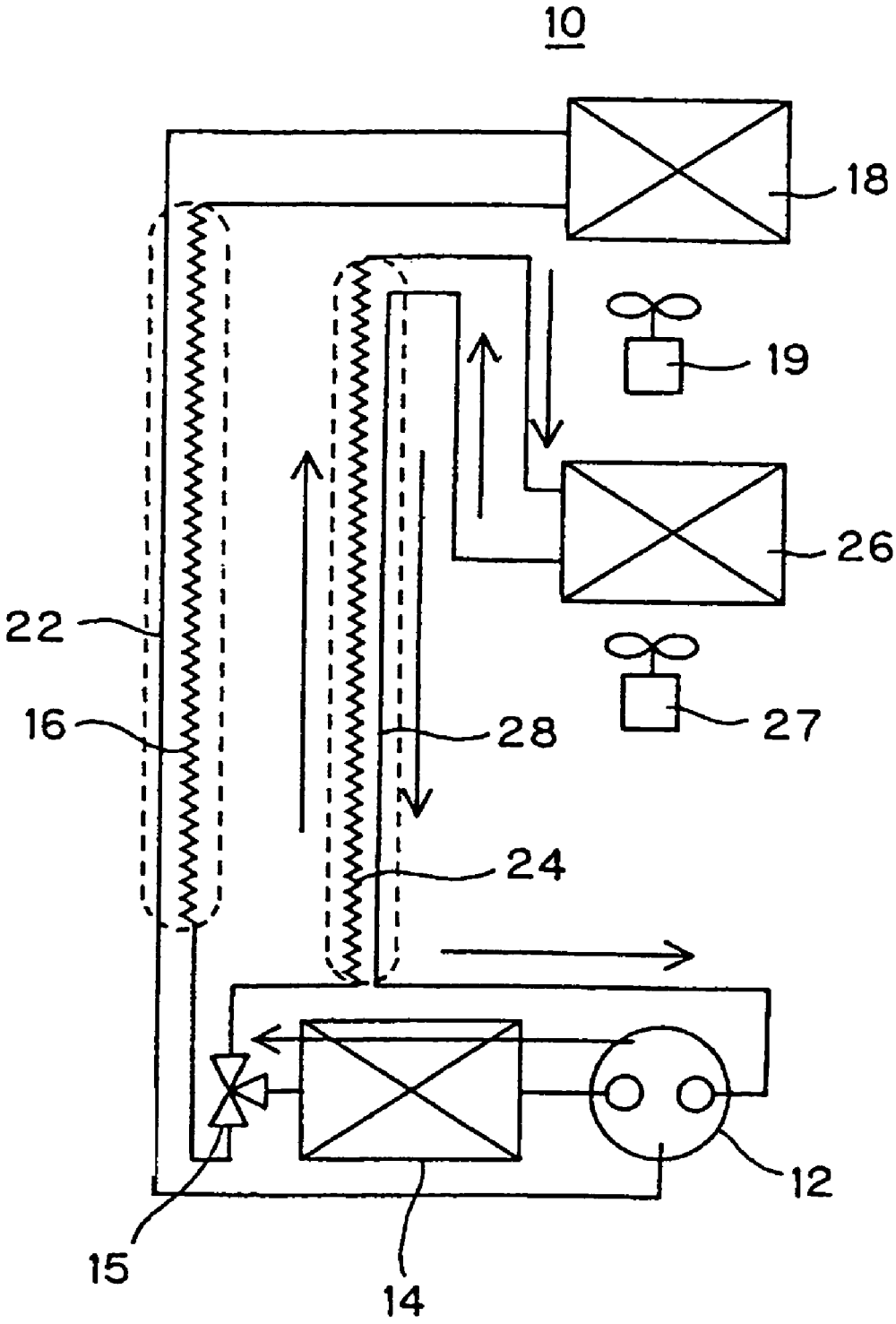
FIG. 2 shows the same refrigerating cycle in a freezer mode.
Figure 3:
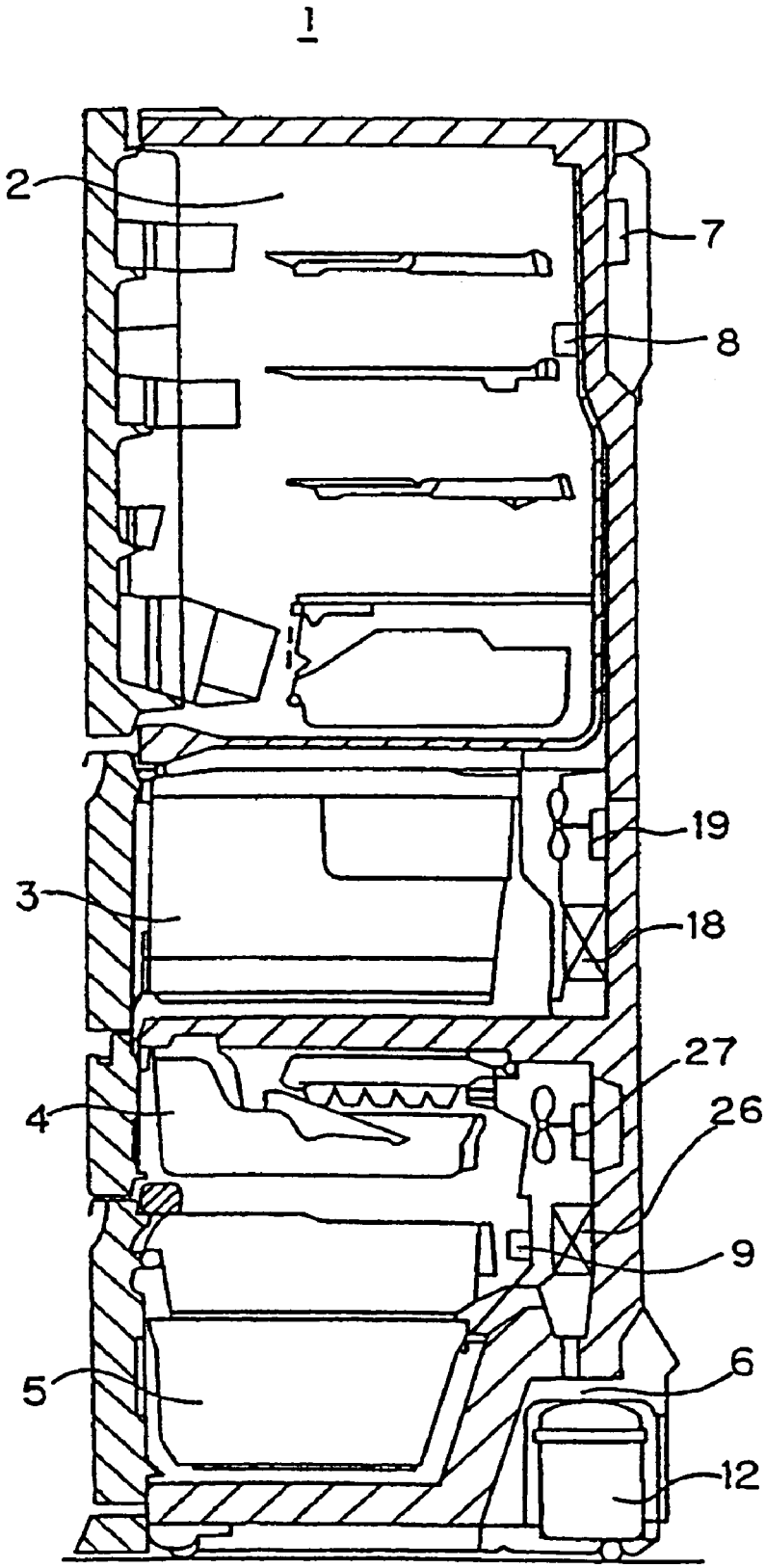
FIG. 3 is a vertical sectional view of a refrigerator of the preferred embodiment.
Figure 4:
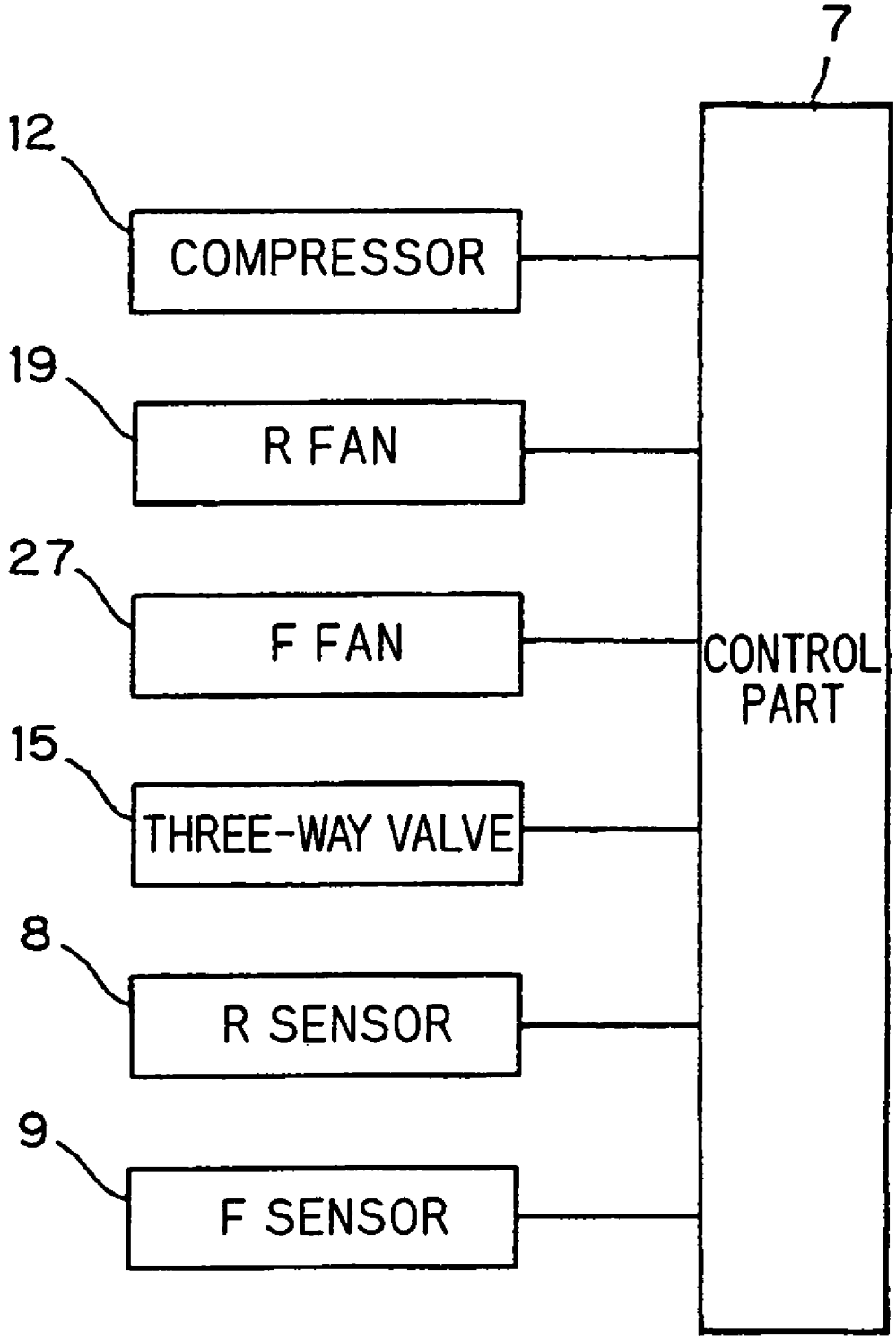
FIG. 4 is a block diagram of the refrigerator.

The invention claimed is:

1. A refrigerator having a refrigerating cycle, comprising:

a high-pressure delivery outlet of a two-stage compression compressor connected to a condenser, the condenser connected to coolant flow path switching means;

a first outlet of the switching means connected via a high-pressure side capillary tube and a refrigerator compartment evaporator to an intermediate-pressure intake of the two-stage compression compressor; and a second outlet of the switching means connected via a low-pressure side capillary tube to a freezer compartment evaporator, the freezer compartment evaporator connected via a low-pressure suction pipe to a low-pressure intake of the two-stage compression compressor, wherein the switching means switches between a simultaneous cooling mode in which coolant is passed to the refrigerator compartment evaporator and the freezer compartment evaporator simultaneously and a freezer mode in which coolant is passed to the freezer compartment evaporator only;

the refrigerator further includes control means for controlling the switching means to switch to the freezer mode when, in the simultaneous cooling mode, the interior temperature of the refrigerator compartment has fallen to a predetermined temperature; and after a predetermined time elapses from the start of the simultaneous cooling mode, the control means switches to the freezer mode even when the interior temperature of the refrigerator compartment has not fallen to the predetermined temperature.

2. A refrigerator having a refrigerating cycle, comprising:

a high-pressure delivery outlet of a two-stage compression compressor connected to a condenser, the condenser connected to coolant flow path switching means;

a first outlet of the switching means connected via a high-pressure side capillary tube and a refrigerator compartment evaporator to an intermediate-pressure intake of the two-stage compression compressor; and a second outlet of the switching means connected via a low-pressure side capillary tube to a freezer compartment evaporator, the freezer compartment evaporator connected via a low-pressure suction pipe to a low-pressure intake of the two-stage compression compressor, wherein the switching means switches between a simultaneous cooling mode in which coolant is passed to the refrigerator compartment evaporator and the freezer compartment evaporator simultaneously and a freezer mode in which coolant is passed to the freezer compartment evaporator only;

the refrigerator further includes control means for controlling the switching means to switch to the freezer mode when, in the simultaneous cooling mode, the interior temperature of the refrigerator compartment has fallen to a predetermined temperature; and after a predetermined time elapses from the start of the freezer mode, the control means switches to the simultaneous cooling mode.

* * * * *